US010145208B2

(12) United States Patent
Leitch

(10) Patent No.: US 10,145,208 B2
(45) Date of Patent: Dec. 4, 2018

(54) ANNULUS INSTALLED 6 ZONE CONTROL MANIFOLD

(71) Applicant: CONOCOPHILLIPS COMPANY, Houston, TX (US)

(72) Inventor: John Cochrane Leitch, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 398 days.

(21) Appl. No.: 15/142,837

(22) Filed: Apr. 29, 2016

(65) Prior Publication Data

US 2017/0022790 A1 Jan. 26, 2017

Related U.S. Application Data

(60) Provisional application No. 62/155,167, filed on Apr. 30, 2015.

(51) Int. Cl.

| | |
|---|---|
| ***E21B 34/10*** | (2006.01) |
| ***E21B 43/14*** | (2006.01) |
| ***F15B 11/20*** | (2006.01) |
| ***E21B 34/00*** | (2006.01) |
| ***E21B 43/12*** | (2006.01) |
| ***F15B 13/07*** | (2006.01) |
| *E21B 43/26* | (2006.01) |

(52) U.S. Cl.

CPC ..... *E21B 34/10* (2013.01); *E21B 34/00* (2013.01); *E21B 43/12* (2013.01); *E21B 43/14* (2013.01); *F15B 11/20* (2013.01); *F15B 13/07* (2013.01); *E21B 43/26* (2013.01); *F15B 2211/3052* (2013.01); *F15B 2211/30505* (2013.01); *F15B 2211/30565* (2013.01); *F15B 2211/3138* (2013.01); *F15B 2211/329* (2013.01); *F15B 2211/40576* (2013.01); *F15B 2211/428* (2013.01); *F15B 2211/50518* (2013.01); *F15B 2211/511* (2013.01); *F15B 2211/5153* (2013.01); *F15B 2211/783* (2013.01)

(58) Field of Classification Search

CPC ..... E21B 34/10; E21B 43/14; E21B 34/00; E21B 43/12; F15B 13/07

See application file for complete search history.

(56) References Cited

U.S. PATENT DOCUMENTS

| | | | | |
|---|---|---|---|---|
| 3,993,100 | A * | 11/1976 | Pollard | E21B 33/035 137/628 |
| 4,549,578 | A | 10/1985 | Hibbs et al. | |
| 6,470,970 | B1 * | 10/2002 | Purkis | E21B 23/04 166/319 |
| 6,567,013 | B1 * | 5/2003 | Purkis | E21B 23/04 166/319 |

(Continued)

OTHER PUBLICATIONS

Konopczynski, Mike—"A Sign of Good Things to Come?", 2012, Oilfield Technology reprint from Halliburton Intelligent Completions, pp. 50-53; 4 pgs.

(Continued)

*Primary Examiner* — Blake E Michener

(74) *Attorney, Agent, or Firm* — ConocoPhillips Company

(57) ABSTRACT

A method of controlling a plurality of downhole tools in a wellbore, using first and second codes transmitted by hydraulic line to first address and then actuate the desired tool. A dedicated line is provided for terminating all actuated tools.

18 Claims, 2 Drawing Sheets

(56) References Cited

U.S. PATENT DOCUMENTS

| | | | | |
|---|---|---|---|---|
| 7,306,043 | B2 * | 12/2007 | Toekje | E21B 23/04 166/319 |
| 2002/0007946 | A1 | 1/2002 | Purkis et al. | |
| 2003/0048197 | A1 * | 3/2003 | Purkis | E21B 23/04 340/853.1 |
| 2005/0087344 | A1 * | 4/2005 | Toekje | E21B 23/04 166/375 |
| 2009/0223663 | A1 * | 9/2009 | Snider | E21B 47/12 166/250.15 |
| 2009/0243875 | A1 * | 10/2009 | Mandrou | E21B 23/04 340/854.9 |
| 2012/0168174 | A1 | 7/2012 | Vaghi et al. | |
| 2015/0107848 | A1 | 4/2015 | Leitch | |

OTHER PUBLICATIONS

"Digital Hydraulics™ Downhole Control System", 2013, Completion Solutions, Halliburton Intelligent Completions, Flow Control, 3 pgs.

* cited by examiner

FIGURE 1: PRIOR ART

ANNULUS INSTALLED 6 ZONE CONTROL MANIFOLD

PRIOR RELATED APPLICATIONS

This application is a non-provisional application which claims benefit under 35 USC § 119(e) to U.S. Provisional Application Ser. No. 62/155,167 filed Apr. 30, 2016, entitled "ANNULUS INSTALLED 6 ZONE CONTROL MANIFOLD," which is incorporated herein in its entirety.

FEDERALLY SPONSORED RESEARCH STATEMENT

Not applicable.

FIELD OF THE DISCLOSURE

The disclosure generally relates to oil and gas production, and in particular to differential hydraulic control of downhole tools.

BACKGROUND OF THE DISCLOSURE

In the production of oil and gas many tools are used downhole, and a way to control those tools from the surface or other remote location is needed. For example, in hydraulic fracturing or "fracking" it is common to frack one zone at a time and thus, fluid access to a single zone at a time is required, and typically achieved with packers, sliding sleeves, valves and the like, that allow access to the zone being fractured. As another example, production from one of several zones intersected by a well may be halted due to water invasion or steam breakthrough, while production continues from the other zones. As yet another example, one zone may be in communication with a production tubing string, while the other zones are shut in.

Due to the need to work different zones at different times, one must be able to differentially shut in one or more zones by differentially controlling various valves or sliding sleeves, and the like. Furthermore, there are many other downhole tools that are differentially controlled from the surface.

Various systems have been used to differentially control multiple downhole well tools. One type of system utilizes electrical signals to select from among multiple well tools for differential operation. Another system uses pressure pulses on hydraulic lines, with the pulses being counted by the individual tools to select particular tools for operation thereof.

However, these systems are less than ideal. Electrical systems typically have temperature limitations or are prone to conductivity and insulation problems, particularly where integrated circuits are utilized or connectors are exposed to hot, corrosive well fluids. Pressure pulse systems are typically very complex and, therefore, very expensive and susceptible to failure at multiple points.

U.S. Pat. No. 6,567,013 describes a significant advance in the differential control of downhole tools. That patent uses a series of hydraulic lines to address and actuate downhole tools. Multiple hydraulic lines are connected to a plurality of tools, and the lines used in a binary fashion to address and actuate individual tools. For example, if there are three lines A, B, C, pressure applied in a code of 001 (C line being pressurized) might mean open tool 1, and 010 (B line being pressurized) might mean close tool 1. With three lines, three tools can be opened and closed using such a binary code.

However, the coding described in U.S. Pat. No. 6,567,013 is somewhat limited, and for 6 tools, 3 lines would be required. Adding lines is certainly possible, but typically there is a limited amount of space downhole, and thus a limit to the number of lines that can be used.

As one option for allowing the control of additional tools, the U.S. Pat. No. 6,567,013 describes the use of four lines, which allowed the control of 12 actuators. However, this system was complex, each control device requiring two check valves, two relief valves and six pilot operated valves to operate. These components are less robust than needed in a downhole environment, where debris tolerance is needed. In addition, U.S. Pat. No. 6,567,013 requires 2 different pressure levels, which cannot be done in currently sub sea control systems. Thus, specialized systems are needed to provided this, contributing to costs.

Therefore, there is a need in the art to further improve the ideas presented in U.S. Pat. No. 6,567,013 and reduce the complexity so that even more tools can be controlled, but with fewer and more robust parts.

SUMMARY OF THE DISCLOSURE

The disclosure relates to a novel coding system for differentially hydraulically actuated downhole tool method, devices, and systems.

In this disclosure, we use 1 of the 4 lines for addressing 2 of the zones, and then one of the 2 lines not used for addressing is used for actuating one of the tool for the zones addressed and the other actuates the $2^{nd}$ tool of the zone being addressed, e.g., moving a valve to an open state. The fourth line closes all actuated tools or valves.

The 4 hydraulic lines emerge from the bottom of the tubing hanger allowing control up to 6 downhole control valves. The control pattern is as follows:

Hydraulic line 1 addresses zones 1 and 2.
Hydraulic line 2 is the actuating hydraulic line for zone 1.
Hydraulic line 3 is the actuating hydraulic line for zone 2.
Hydraulic line 2 addresses zones 3 and 4.
Hydraulic line 1 is the actuating hydraulic line for zone 3.
Hydraulic line 3 is the actuating hydraulic line for zone 4.
Hydraulic line 3 addresses zones 5 and 6.
Hydraulic line 1 is the actuating hydraulic line for zone 5.
Hydraulic line 2 is the actuating hydraulic line for zone 6.
Hydraulic line 4 is a common close line for all 6 zones.

In this manner, 6 tools or valves are controlled with just four lines. Further, each line needs only an on or off pressure state—no differential pressure coding is used. Thus, the mechanical elements described in U.S. Pat. No. 6,567,013 for responding to higher and lower pressure states (e.g. relief valve, check valve, or pilot valve) are not needed, and the overall system is simplified.

In addition, this system will operate with any downhole valve design, whereas U.S. Pat. No. 6,567,013 only operated with piston type valves, not indexing valves. The system described herein will also operate any current incrementing devices that are used to incrementally open the piston type down hole tools.

The method, device and system can be used to control piston type flow control valves or indexing type flow control valves.

The invention thus includes any one or more of the following embodiments, in any combination(s) thereof:

A method of hydraulically controlling multiple well tools in a well, comprising the steps of:

a) providing a set of first hydraulic lines;

b) providing a closing hydraulic line;

c) wherein each of said first hydraulic lines and said closing hydraulic line is fluidly connected to a plurality of addressable control devices, each connected to a plurality of actuators controlling a plurality of tools;

d) selecting a tool for actuation by generating a first code on the first hydraulic lines by applying a first hydraulic pressure to one or more hydraulic lines;

e) activating the selected tool by generating a second code on the first hydraulic lines by applying the first hydraulic pressure to one or more hydraulic lines; and f) terminating the activation of said tool by applying the first hydraulic pressure to said closing hydraulic line.

A system of hydraulically controlling multiple well tools in a well, comprising:

a) a set of first hydraulic lines;

b) a closing hydraulic line;

c) wherein each of said activation hydraulic lines and said closing hydraulic line is fluidly connected to a plurality of addressable control devices, each connected to a plurality of actuators controlling a plurality of tools;

d) a pressure source fluidly attached to each of said first hydraulic lines and said closing hydraulic line; and e) and said system is activated by a single on pressure and a single off pressure applied using a binary code delivered to said addressable control devices by said on pressure and said off pressure.

| Pressurized Line at t = 1 | Pressurized Line at t = 2 | Actuation zone |
|---|---|---|
| 1 | 2 | 1 |
| 1 | 3 | 2 |
| 2 | 1 | 3 |
| 2 | 3 | 4 |
| 3 | 1 | 5 |
| 3 | 2 | 6 |
| 4 | All actuations halted/closed | |

A method or system as herein described, wherein said addressable control devices are piston valves, sliding piston valves, indexing valves or a combination thereof.

As used herein, "code" means a plus or minus (on/off) set of pressure levels on a set of hydraulic lines. For example, 1,000 psi may be present one hydraulic line, and 0 psi (or near zero) may be present on others to thereby transmit a particular code corresponding to an address of the control device. 1,000 psi is exemplary only and any pressure can be used, but it is a feature of the system that all active lines use the same pressure, thereby simplifying the control system for the hydraulic lines.

There is no differential pressure use other than the on or off state. It is also recognized that the zero pressure state will typically be some ambient pressure, rather than a true zero pressure state, e.g., vacuum is not required, nor is it needed to remove fluid from the lines, but only to open the line so it can equalize to an ambient pressure state.

Due to the long distances which may be involved in positioning well tools in deep wells, more or less time may be required to receive the code at the control devices. Deeper tools will of course require additional time for a pressure signal to be received.

Nevertheless, it will be readily appreciated by one skilled in the art that this method of transmitting a code or address via the hydraulic lines is substantially different, and far easier to accomplish, than e.g., applying a series of pressure pulses on a hydraulic line. Also, there is only one manifold in the well so less components increasing reliability, as opposed to six in U.S. Pat. No. 6,567,013, thus the system is far simpler and requires less space. Further, it is more robust than electrical systems, and less complex that the prior art system of U.S. Pat. No. 6,567,013.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, coupling elements, and the like.

The following abbreviations are used herein:

| ABBREVIATION | TERM |
|---|---|
| psi | Pounds per square inch |

DETAILED DESCRIPTION

A digital hydraulic well control system is provided which utilizes hydraulic lines to first "select" one or more well tools for operation thereof, and then utilizes a different combination of hydraulic lines to "actuate" the selected well tool(s). The use of electricity downhole is not required, nor is use of complex pressure pulse decoding mechanisms required. Further, no differential pressures are required, nor the hardware needed to respond to differential pressures.

In one aspect of the present invention, a method of hydraulically controlling multiple well tools in a well is provided. A set of hydraulic lines is interconnected to each of the tools. A pair of tools is selected for actuation thereof by pressurizing one of the hydraulic lines. Of those two lines, one is activated by pressurizing a second different line. A dedicated line is used to terminate all actuations, thus halting the tool or closing the valve.

The code is thus a two step combination of off or on pressure in the set of hydraulic lines. Neither pressure pulses, nor differential pressures are used. Rather, the line is either activated or not, and any pressure level for activation will work. The benefit of using the same pressure in all lines is simplification of the control mechanisms at the wellpad.

If the system has four lines, and one line is a dedicated closure line, this leaves any one of three lines to select a pair of tools, and one of the pair is activated by one of the remaining two lines. Thus a combination of six tools (3×2=6) can be independently controlled with this simplified system.

If the system has five lines, and one line is a dedicated closure line, this leaves any one of four lines to select a pair of tools, and one of the pair is activated by one of the remaining three lines. Thus a combination of eight tools (4×2=8) can be independently controlled with this simplified system.

The system can be expanded further, so long as there is sufficient space in the annulus to house the lines.

These and other features, advantages, benefits and objects of the present invention will become apparent to one of ordinary skill in the art upon careful consideration of the detailed description of representative embodiments of the invention herein below and the accompanying drawings.

The present invention is exemplified with respect to shuttle valves and pistons. However, this is exemplary only, and the invention can be broadly applied to a wide range of downhole tools. The following examples are intended to be illustrative only, and not unduly limit the scope of the appended claims.

Prior Art System

Figure 1:
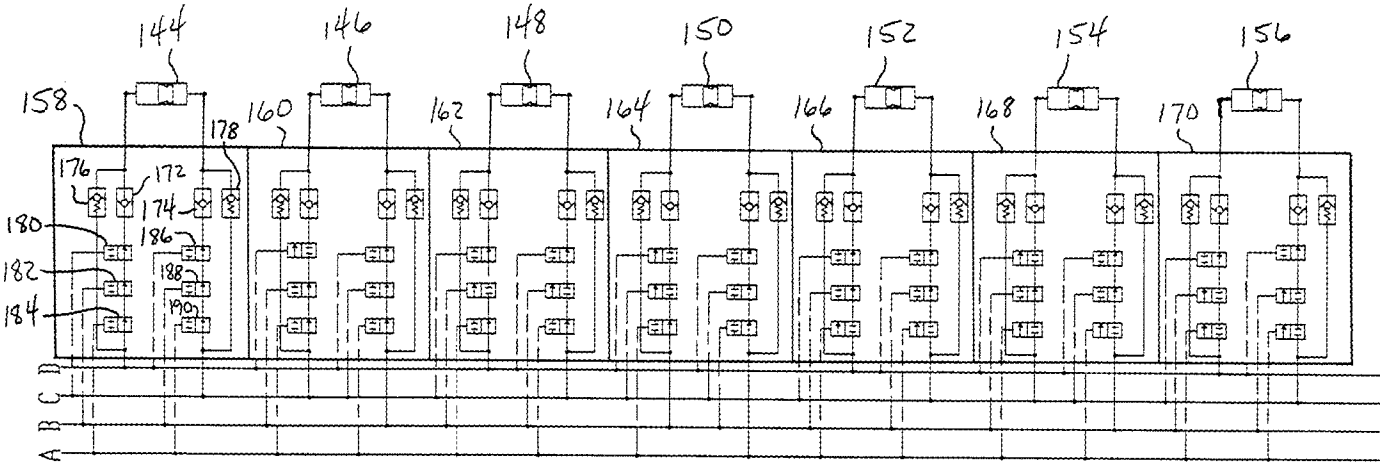
FIG. 1. PRIOR ART hydraulic control system.

FIG. 1 shows the four line actuator system from U.S. Pat. No. 6,567,013 and is provided to more clearly distinguish the improvements disclosed herein as compared to this prior art system.

The hydraulic schematic shown in FIG. 1 has seven actuators 144, 146, 148, 150, 152, 154, 156 controlled by seven respective control devices 158, 160, 162, 164, 166, 168, 170, and four hydraulic lines A, B, C, D. Well tools actuated by the actuators 144, 146, 148, 150, 152, 154, 156 are not shown in FIG. 1 for simplicity, but it is understood that in actual practice a well tool is connected to each of the actuators.

For the example illustrated in FIG. 1, the following table shows the manner in which the actuators 144, 146, 148, 150, 152, 154, 156 are selected using the addresses:

| A | B | C | D | Actuation |
|---|---|---|---|---|
| 0 | 0 | 0 | 1 | Displace Actuator 144 Piston to the Right |
| 0 | 0 | 1 | 0 | Displace Actuator 144 Piston to the Left |
| 0 | 0 | 1 | 1 | Displace Actuator 146 Piston to the Right |
| 0 | 1 | 0 | 0 | Displace Actuator 146 Piston to the Left |
| 0 | 1 | 0 | 1 | Displace Actuator 148 Piston to the Right |
| 0 | 1 | 1 | 0 | Displace Actuator 148 Piston to the Left |
| 0 | 1 | 1 | 1 | Displace Actuator 150 Piston to the Right |
| 1 | 0 | 0 | 0 | Displace Actuator 150 Piston to the Left |
| 1 | 0 | 0 | 1 | Displace Actuator 152 Piston to the Right |
| 1 | 0 | 1 | 0 | Displace Actuator 152 Piston to the Left |
| 1 | 0 | 1 | 1 | Displace Actuator 154 Piston to the Right |
| 1 | 1 | 0 | 0 | Displace Actuator 154 Piston to the Left |
| 1 | 1 | 0 | 1 | Displace Actuator 156 Piston to the Right |
| 1 | 1 | 1 | 0 | Displace Actuator 156 Piston to the Left |

Displacement of an actuator piston to the right may be used to open a valve and displacement of an actuator piston to the left may be used to close a valve, or the piston displacements may be used for other purposes or in controlling other types of well tools.

Additionally, note that each control device 158, 160, 162, 164, 166, 168, 170 has two distinct addresses, but in practice more than one control device may have the same address, a control device may have a number of addresses other than two, etc. This feature is the same in the current invention. Thus, a zone may have two or more tools synchronously controlled.

Only the operation of the control device 158 will be described in detail below, it being understood that the other control devices 160, 162, 164, 166, 168, 170 are operated in a similar manner.

Control device 158 includes two check valves 172, 174, two relief valves 176, 178 and six normally open pilot operated valves 180, 182, 184, 186, 188, 190. The control device 158 has addresses 0001 and 0010 for operating the actuator 144. When the code 0001 is present on the hydraulic lines A, B, C, D (i.e., the predetermined pressure level is on line D, but not on lines A, B or C), pilot operated valves 180, 182, 184 are open, permitting fluid pressure in hydraulic line D to be transmitted to the actuator 144. When the fluid pressure exceeds the opening pressure of the relief valve 178 (e.g., 1,500 psi), it is transmitted to hydraulic line C and the actuator 144 piston is displaced to the right.

When the code 0110 is present on the hydraulic lines A, B, C, D, pilot operated valves 186, 188, 190 are open, permitting fluid pressure in hydraulic line C to be transmitted to the actuator 144. When the fluid pressure exceeds the opening pressure of the relief valve 176, it is transmitted to hydraulic line D and the actuator 144 piston is displaced to the left.

Thus, the well control system of FIG. 1 demonstrates that any number of hydraulic lines may be utilized to control any number of well tool assemblies. However, the use of the differential pressure system in the prior art necessitates the use of relief valves, thus complicating the system. Additionally, the prior art differential pressure system has all the zone control system in each zone to be controlled. This can result in large differential pressures on the components, which could cause failure. Further, a manifold is required for each control device that controls the tools, i.e. if there are six zones, U.S. Pat. No. 6,567,013 then requires space to accommodate a six line manifold and subsequent switches to control the tools. This creates additional complications for wellpad operation and maintenance.

Inventive System

Please review the highlighted paragraphs carefully, as we had to guess at same from an unlabeled figure.

Figure 2:
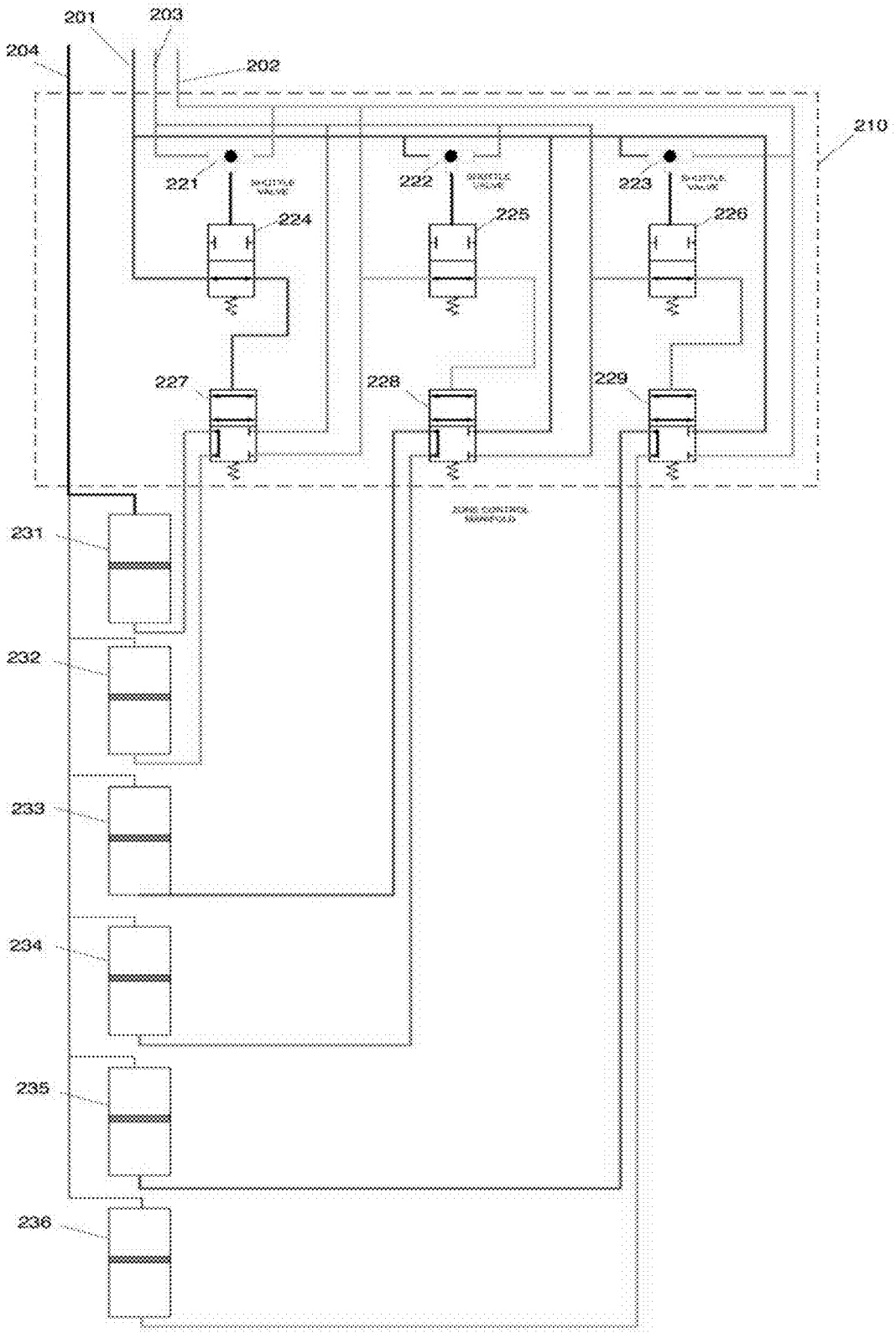
FIG. 2. Inventive hydraulic control system for differentially operating six different tools and/or zones in the well.

FIG. 2 shows the invented system, with one closure line, three activation lines, each connected to two addressable control devices, which in turn are connected to tools (not shown for simplicity). Each of those lines are connected to a pressure source, typically on or near the wellpad. One single zone control manifold, housed in the annulus (not shown) contains the control system, including shuttle valves and e.g., sliding piston valves.

One exemplary coding system can be described as follows:

| |
|---|
| Hydraulic line 1 addresses zones 1 and 2 |
| Hydraulic line 2 actuates zone 1 |
| Hydraulic line 3 actuates zone 2 |
| Hydraulic line 2 addresses zones 3 and 4 |
| Hydraulic line 1 actuates zone 3 |
| Hydraulic line 3 actuates zone 4 |
| Hydraulic line 3 addresses zones 5 and 6 |
| Hydraulic line 1 actuates zone 5 |
| Hydraulic line 2 actuates zone 6 |
| Hydraulic line 4 is the common close line for all 6 zones |

From the above table, it can be seen that to activate the tool in zone one, the lines 1 and 2 are pressurized in that order. In contrast, if line 2 is pressurized first, then 1, the actuated zone would be zone 3. Thus, in addition to the binary activation code where hydraulic lines are either pressurized or not, there is a time element. This can be accomplished, e.g., with the use of sliding pistons, shuttle valves, and similar switches.

Referring to FIG. 2, the Pressure Source (not shown) is connected to activation lines 201, 202, 203 and closure line 204 to transmit hydraulic signal through these lines. As shown in FIG. 2, the manifold 210 is configured such that two zones are associated with the same address, thus the six zones can be addressed by three activation lines 201, 202, 203. Further, the manifold 210 is configured such that among the three activation lines, if one of them is used to select a pair of addressable zones, the remaining two activation lines are used to actuate each of these selected addressable zones.

For example, activation line 201 is used to select zones 231, 232, and the manifold 210 is configured such that activation line 203 is used to actuate zone 231, and activation line 202 is used to actuate zone 232. Similarly, activation line 203 is used to select addressable zones 233, 234, while activation lines 201, 202 are used to actuate zones 233, 234, respectively; and activation line 202 is used to select addressable zones 235, 236, while activation lines 201, 203 are used to actuate zones 235, 236, respectively. This feature will be discussed in more detail below.

The zone control manifold 210 is configured such that each pair of addressable zones 231 and 232, 233 and 234, 235 and 236 is only accessible if the hydraulic signal can change the valve position of pilot-operated normally closed valves 227, 228 or 229, respectively. Each of these valves 227, 228, 229 are normally closed, but upon pressurized signal from upstream two flow paths will be switched to open. The position of valve 227 is controlled by activation line 201 through an upstream valve 224, valve 228 by activation line 202 through an upstream valve 225, and valve 229 by activation line 203 through an upstream valve 226. Valves 224, 225, 226 are pilot-operated normally open valves that are in turn controlled by upstream shuttle valves 221, 222, 223, respectively. Pressurized fluid through shuttle valve 221, 222, 223 can switch closed the flow path in normally open valves 224, 225, 226 such that no further pressurized fluid can flow through them to further alter the valve position in downstream normally closed valves 227, 228, 229.

Take zones 231 and 232 for example, both of which have the same address that can be selected if activation line 201 is pressurized at a predetermined pressure at t=1. The predetermined pressure in this example is 5,000 psi, but can be higher or lower depending on the wellpad configuration and settings. Activation line 201 is connected to the to a pilot-operated, normally open valve 224, and operably connected to a pilot-operated normally closed valve 227, which then operably connected to zones 231, 232. A shuttle valve 221 operably connected to and controls the pilot-operated normally open valve 224, and the shuttle valve 221 is further connected to activation lines 202 and 203. The pilot-operated normally closed valve 227 is also connected to the activation lines 202 and 203, wherein if the valve 227 is switched to open position by the activation line 201, pressurization of either of the activation lines 202, 203 can then actuate zone 231 or 232.

To actuate tools in zone 231, the first step is to generate an address signal that select zones 231 and 232, in which case activation line 201 is pressurized, whereas the pressure of activation lines 202 and 203 remains unchanged. The pressurized fluid in activation line 201 will flow through the pilot-operated normally open valve 224, and further travel to switch open the pilot-operated normally closed valve 227. Therefore zones 231 and 232 are selected because only zones 231, 232 have open path at valve 227. Pressurized fluid in activation line 201 also flow through shuttle valves 222 and 223, keeping pilot-operated normally open valves 225, 226 closed. Because the other valves 225, 226 are still closed, pressurization of either of activation lines 202, 203 will not select zones 233, 234, 235, 236.

The second step is to actually actuate zone 231. As predetermined by the code, zone 231 is to be actuated by activation line 203. Therefore, pressurization of activation line 203 at this time will cause the following: (1) switching off shuttle valve 221, thereby closing valve 224, and (2) flowing through the path in pilot-operated valve 227. The pressurized fluid in line 203 then can travel down to zone 231 to actuate the tools connected therewith. In the mean time, because pilot-operated valve 226 is still closed by activation line 201 through shuttle valve 223, the pressurized fluid in line 203 will not switch open the pilot-operated normally closed valve 229.

Alternatively, if zone 232 is to be selected and actuated, the selection step of pressurizing line 201 is still the same. The actuation step now pressurizes line 202, which also (1) switches closed valve 224, and (2) flow through the path in pilot-operated valve 227 so the pressurized fluid in line 202 can further travel to zone 232 to actuate tools connected therewith.

Similar logic can be used to select and actuate zone pairs 233, 234 and 235, 236. For example, to actuate either of zones 233, 234, the first selection step is to pressurize line 202 to switch open pilot-operated normally closed valve 228, while switching closed pilot-operated normally open valves 224, 226 through shuttle valves 221, 223, respectively. Then, depending on whether zone 233 or 234 is to be actuated, activation line 201 or 203 is pressurized accordingly, since both paths in the pilot-operated normally closed valve 228 are now open.

To select zone pairs 235, 236, first pressurize line 203 to switch open pilot-operated normally closed valve 229, while switching closed pilot-operated normally open valves 224, 225 through shuttle valves 221, 222, respectively. Then, depending on whether zone 235 or 236 is to be actuated, activation line 201 or 202 is pressurized accordingly, since both paths in the pilot-operated normally closed valve 229 are now open.

The codes can be represented as follows:

| Pressurized Line at t = 1 | Pressurized Line at t = 2 | Actuation zone |
|---|---|---|
| 1 | 2 | 1 |
| 1 | 3 | 2 |
| 2 | 1 | 3 |
| 2 | 3 | 4 |
| 3 | 1 | 5 |
| 3 | 2 | 6 |
| 4 | All actuations halted/closed | |

Similarly, if a fifth line is added, then 8 zones could be controlled having a single line dedicated to system closure using the two time point address/activation code illustrated herein.

Although not shown herein, the hydraulic lines extend to the earth's surface, or another remote location, where fluid pressure on each of the lines may be controlled using conventional pumps, valves, accumulators, computerized controls, etc. Further, the pressurizing system and its controls are simplified, since only a single pressure is used.

A person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, the above examples of embodiments of the present invention have utilized valves and a particular set of addressing codes. However, any tool can be controlled in this manner, and the addressing codes can vary. Accordingly, the foregoing detailed description is to be clearly understood as being given by way of illustration and example only, the spirit and scope of the present invention being limited solely by the appended claims.

The following art is incorporated by reference herein in its entirety for all purposes: U.S. Pat. No. 6,567,013, Purkis & Bouldin, "Digital hydraulic well control system," (2003). Konopczynski, "Intelligent Completions–A Sign of Good Things to Come?" (2012) Halliburton, "Digital Hydraulics™ Downhole Control System." (2013)

What is claimed is:

1. A method of hydraulically controlling multiple well tools in a well, comprising the steps of:

a) providing a set of first hydraulic lines;

b) providing a closing hydraulic line;

c) wherein each of said first hydraulic lines and said closing hydraulic line is fluidly connected to a plurality of addressable control devices, each connected to a plurality of actuators controlling a plurality of tools;

d) selecting a tool for actuation by generating a first code on the first hydraulic lines by applying a first hydraulic pressure to one of the first hydraulic lines;

e) activating the selected tool by generating a second code on the first hydraulic lines by applying the first hydraulic pressure to one or more of the first hydraulic lines that are not used in the selecting step d); and f) terminating the activation of said tool by applying the first hydraulic pressure to said closing hydraulic line.

2. The method of claim 1, wherein the set of first hydraulic lines are three first hydraulic lines and where the plurality of tools are 6 tools.

3. The method of claim 2, wherein the 6 tools are controlled as follows:

| Pressurized Line at step (d) | Pressurized Line at step (e) | Actuation tool |
|---|---|---|
| 1 | 2 | 1 |
| 1 | 3 | 2 |
| 2 | 1 | 3 |
| 2 | 3 | 4 |
| 3 | 1 | 5 |
| 3 | 2 | 6 |
| 4 | All actuations halted/closed. | |

4. The method of claim 1, wherein the set of first hydraulic lines are four first hydraulic lines and where the plurality of tools are 8 tools.

5. The method of claim 1, wherein the set of first hydraulic lines are three first hydraulic lines and where the plurality of tools are 6 valves.

6. The method of claim 1, wherein the set of first hydraulic lines are four first hydraulic lines and where the plurality of tools are 8 valves.

7. The method of claim 1, wherein the set of first hydraulic lines are three first hydraulic lines and where the plurality of tools are 6 valves controlling fluid access to 6 zones in a well.

8. The method of claim 1, wherein the set of first hydraulic lines are four first hydraulic lines and wherein the plurality of tools are 8 valves controlling fluid access to 8 zones in a well.

9. The method of claim 1, wherein said addressable control devices are piston valves, sliding piston valves, indexing valves or a combination thereof.

10. A system of hydraulically controlling multiple well tools in a well, comprising:

a) a set of first hydraulic lines;

b) a closing hydraulic line;

c) wherein each of said activation hydraulic lines and said closing hydraulic line is fluidly connected to a plurality of addressable control devices, each connected to a plurality of actuators controlling a plurality of tools;

d) a pressure source fluidly attached to each of said first hydraulic lines and said closing hydraulic line; and e) said system is activated by a single on pressure and an off pressure applied using a binary code delivered to said addressable control devices by said on pressure and said off pressure via two of the set of first hydraulic lines each delivering half of the binary code.

11. The system of claim 10, wherein the set of first hydraulic lines are three first hydraulic lines and where the plurality of tools are 6 tools.

12. The system of claim 11, wherein the 6 tools are controlled as follows:

| Pressurized Line for first half of the binary code | Pressurized Line for the second half of the binary code | Actuation zone |
|---|---|---|
| 1 | 2 | 1 |
| 1 | 3 | 2 |
| 2 | 1 | 3 |
| 2 | 3 | 4 |
| 3 | 1 | 5 |
| 3 | 2 | 6 |
| 4 | All actuations halted/closed. | |

13. The system of claim 10, wherein the set of first hydraulic lines are four first hydraulic lines and where the plurality of tools are 8 tools.

14. The system of claim 10, wherein the set of first hydraulic lines are three first hydraulic lines and where the plurality of tools are 6 valves.

15. The system of claim 10, wherein the set of first hydraulic lines are four first hydraulic lines and where the plurality of tools are 8 valves.

16. The system of claim 10, wherein the set of first hydraulic lines are three first hydraulic lines and where the plurality of tools are 6 valves controlling fluid access to 6 zones in a well.

17. The system of claim 10, wherein the set of first hydraulic lines are four first hydraulic lines and wherein the plurality of tools are 8 valves controlling fluid access to 8 zones in a well.

18. The system of claim 10, wherein said addressable control devices are piston valves, sliding piston valves, indexing valves or a combination thereof.

* * * * *